United States Patent [19]

Walter Henry J.

[11] 4,202,360

[45] May 13, 1980

[54] HAIR CURLING ROLLER

[75] Inventor: Walter Henry J., Wilton, Conn.

[73] Assignee: Clairol Incorporated, New York, N.Y.

[21] Appl. No.: 897,809

[22] Filed: Apr. 19, 1978

[51] Int. Cl.[2] ..... A45D 2/00

[52] U.S. Cl. ..... 132/40

[58] Field of Search ..... 132/40, 42, 39, 33 R; 222/519

[56] References Cited

U.S. PATENT DOCUMENTS

| | | | |
|---|---|---|---|
| 3,200,824 | 8/1965 | Coloccia | 132/40 |
| 3,515,152 | 6/1970 | Laughton | 132/33 R |
| 3,541,302 | 6/1970 | Makino | 132/33 R |
| 3,559,658 | 2/1971 | Genest | 132/33 R |
| 3,706,315 | 12/1972 | Johansen | 132/33 R |
| 3,888,266 | 6/1975 | Weldon | 132/39 |
| 4,027,684 | 6/1977 | Mueller | 132/40 |
| 4,109,667 | 8/1978 | Quirk | 132/33 R |

FOREIGN PATENT DOCUMENTS

| | | | |
|---|---|---|---|
| 565415 | 7/1957 | Italy | 132/40 |

*Primary Examiner*—G. E. McNeill
*Attorney, Agent, or Firm*—Sherman & Shalloway

[57] ABSTRACT

A tubular member such as a cartridge which is filled with a material that, upon heating, changes its state from liquid to solid (such as wax) is flocked to enhance heat transfer from the tubular member to hair rolled around the tubular member. Top and bottom snap-on flanged ends of low heat conducting material are connected to the tubular cartridge by a base means having a base portion and base sides. The sides include a plurality of locking means comprised of radial protrusions or a locking portion having a camming surface, a locking lip, and a locking surface, the radial protrusions or locking portions for communication with a groove in the tubular cartridge. Venting is provided in each base portion to promote heat dissipation from the flanged ends. An aperture is provided in the bottom flanged end base portion in registry with an aperture in the tubular cartridge for receiving a means for heating the roller. Crushing ribs may be provided on each base side to contact the flocked tubular cartridge to prevent axial rotation between the flanged ends and the tubular member. Alternatively, the tubular member may be a high heat conducting tubular material having convex protrusions which mate with concave indentations in the base sides. Spacing projections to space the tubular member from the base portion of the flanged ends may be alternatively employed.

15 Claims, 11 Drawing Figures

HAIR CURLING ROLLER

BACKGROUND OF THE INVENTION

1. Field of the Invention

The field of the invention generally relates to hair curling rollers which are heated by electrically heated posts or by other convenient means such as hot mist or steam. The temperature is thermostatically controlled and when the rollers have reached their pre-determined temperatures, they are removed and hair is wound on them.

Specifically, the invention is concerned with a flocked hair roller having snap-on flanged ends to provide a hair curling roller structure which has ease of manufacture and assembly and promotes high heat transfer to the hair.

2. Description of the Prior Art

Flocking of the body of a roller used for curling hair is known in the prior art. For example, U.S. Pat. No. 3,888,266 describes a hair curing roller having a flocked surface which comprises a myriad of upstanding, short, non-hygrosopic filaments or fibers capable of retaining moisture by capillary action.

Attempts to place flocking on the plastic outer sheath of hair curling rollers has not been successful. This is because the heat transfer from the plastic roller covering to an adhesive employed to hold the flocking in place and the heat transfer from the adhesive to the flocking fibers was insufficient to raise hair wound around the curler to a temperature that would impart a lasting curl. It has been found that replacement of the plastic roller covering on the hair contact surface of the roller with a high heat conducting material indicated that sufficient heat transfer between the hair and the roller is obtainable. This is believed to be due to the fact that when using a metallic or other high conducting roller body in electro-static flocking, each fiber penetrates the adhesive so that the fiber ends contact the high heat conductive roller body and are heated directly by conduction.

SUMMARY OF THE INVENTION

It has been discovered that a hair roller structure comprising a tubular member or wax-filled cartridge which can be flocked and assembled with snap-on radial flanged ends provides a hair curing roller with significant advantages and improvements over the prior art. The tubular member may be a high heat conducting material or may be a cartridge filled with a material that changes its state from solid to liquid upon heating such as wax. The flanged ends are comprised of low heat conducting material to prevent heat transfer from the flocked tubular member to an individual's fingers when winding hair onto the roller in a heated condition. Each radial flanged end has a radial flange section which is connected to a base means having base sides which include a locking means communicating with an end of the tubular member. The base means includes a base portion with vents. The bottom flanged end has a base portion with an opening in registry with an aperture in the tubular member for receiving a means for heating the hair roller. Crushing ribs may also be provided on the base side to contact the flocked surface, thereby digging into the flock and preventing axial rotation of the flanged end. The locking means may be provided by concave protrusions on the tubular member which communicate with convex indentations in the base sides.

Alternatively, the locking means may be a radial protrusion or a locking portion having a camming surface, a locking lip and a locking surface for communicating with a radial groove in the tubular member.

It is an object of this invention to provide a flocked hair roller which can be manufactured efficiently and which will provide high heat transfer to the hair in combination with low-heat conducting, flanged ends to allow ease of handling when the roller is in a heated condition.

It is a further object of this invention to provide a flanged end for a flocked hair curling roller having a locking means for engaging an end of a roller body.

It is yet another object of this invention to provide a flanged end for a hair curling roller having a vented base portion with crushing ribs for connection to a flocked tubular member or cartridge.

It is still another object of this invention to disclose a hair roller comprised of a tubular member having protrusions for communication with a flanged end having a base means connected to a radial flange.

It is a further object of this invention to provide a flocked hair curling roller which includes snap-on flanged ends to allow for ease of assembly.

BRIEF DESCRIPTION OF THE DRAWING

These features and objects as well as others will become apparent to those skilled in the art by referring to the drawing and its accompanying specification wherein.

DETAILED DESCRIPTION OF THE INVENTION

Figure 7:
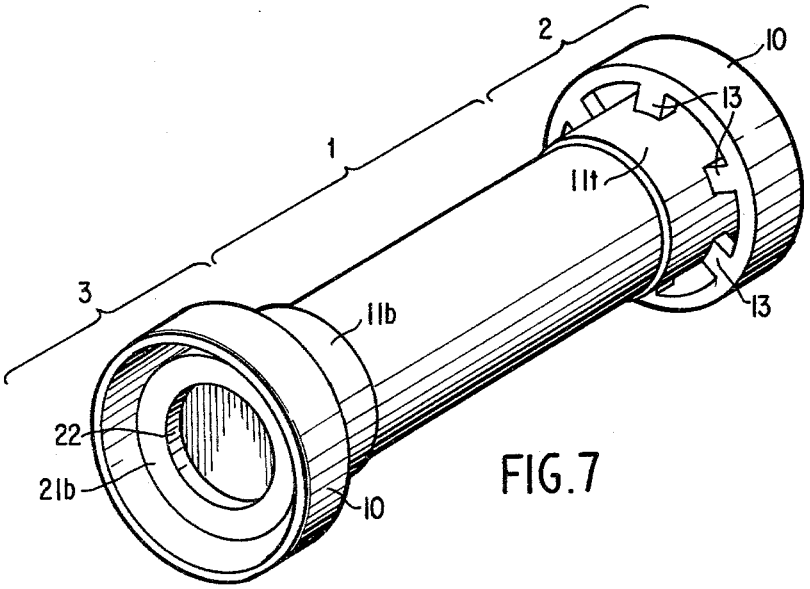
FIG. 7 is a pictorial view of an assembled hair curling roller according to the invention having non-vented flanged ends and a flocked tubular member.
Figure 8A:
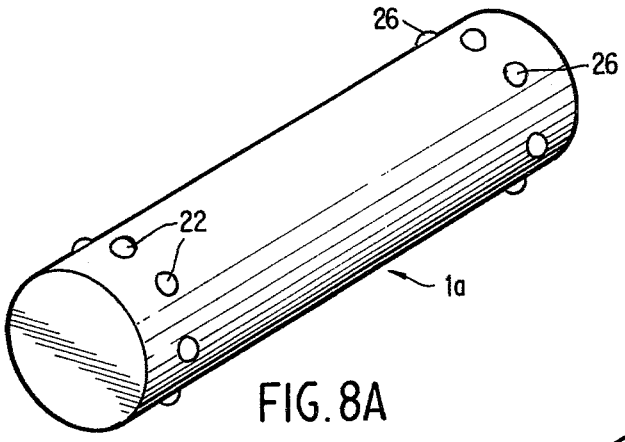
FIGS. 8*a* and 8*b* are views of two embodiments of the tubular member.
Figure 8B:
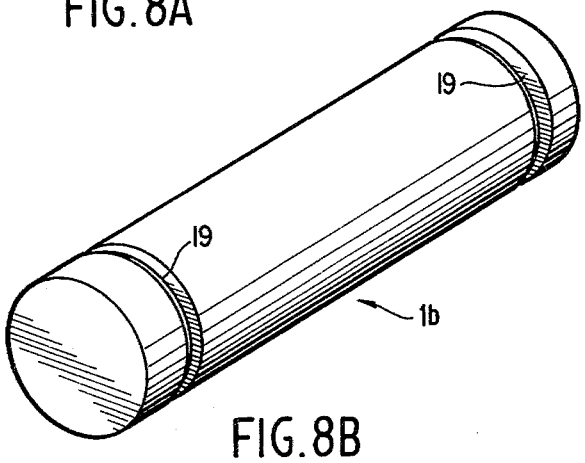
Figure 9:
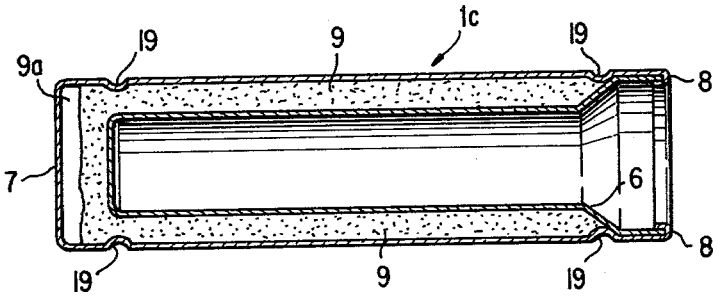
FIG. 9 is a sectional view of the cartridge embodiment of the tubular member.

As shown in FIG. 7, the structure of the roller is generally comprised of tubular member 1, top flanged end 2 and bottom flanged end 3. The tubular member 1 may be any construction which will allow for heat transfer. As shown in FIG. 9, the tubular member 1 can include a wax-filled cartridge generally referred to by reference character 1*c*. In the alternative as shown in FIGS. 8*a* and 8*b*, the tubular member may consist of a plain high-heat conducting tube generally referred to by reference characters 1a and 1b. This tube 1a or 1b can be manufactured from metal or high heat conducting non-metallic materials.

The construction of the preferred metal cartridge 1c may be in accordance with the teachings of U.S. Pat. No. RE 26,766 and U.S. Pat. No. 3,773,057 as illustrated in FIG. 9. The cartridge 1c consists of a metallic inner tube 6 and a metallic outer tube 7. The two tubes 6 and 7 are hermetically sealed at one end 8 by swaging the outer tube 7 over the inner tube 6. The space 9 between the two tubes is filled with a heat-absorbing material that upon heating will change its stage from solid to liquid. Wax has been found especially useful in this regard. On cooling off, the heat of solidification is used for setting of curls. Expansion space 9a is provided to accommodate any volume changes which may occur due to heating or cooling of the cartridge 1c.

The heat-absorbing material provided in the space 9 may be of a kind having a melting point in the range of about 60°–130° C. and a high heat of fusion, such as erythrite, which has a melting point of about 120° C. and a heat of fusion of about 80 cal./g.

The outside surface of the tubular member 1 is flocked in accordance with conventional procedures well known in the art such as taught by Weldon, et al. in U.S. Pat. No. 3,888,266 to provide additional heat transfer. Electro-static flocking employing alternating or direct current to enhance the flocking process is the preferred method for flocking the tubular member 1. Before flocking, the tubular member 1 is covered with an adhesive which must withstand a temperature of 125° C. and water vapor, as these are the conditions the hair rollers are subjected to immediately before use. When employing a cartridge 1c as the tubular member 1, the outer tube 7 is flocked.

Electro-static flocking is preferred because each fiber penetrates the adhesive so that the fiber ends contact the high-heat conductive tubular member 1 and are heated directly by conduction. Electro-static flocking also aligns the fibers perpendicular to the tubular member 1 because the electro-static flocking makes the fibers fall end first. This gives virtually 100 percent vertical orientation of the fibers although beater-bars are often used along with AC electro-static flocking to give better penetration into any adhesive coat which may cover the surface to be flocked. When using direct current electro-static flocking, air-borne delivery of the fibers may also be employed. The air current delivery provides better coverage.

Regarding the adhesive, any adhesive which will adhere to both the chosen flock fiber and the tubular member 1 and withstand the noted conditions above may be employed. The percentage of solids within the adhesive may be varied in order to hold the fibers after drying. Depending on the type of hair roller, the adhesive may also include specific characteristics such as flexibility, rigidity, washability or any other properties which will enhance the use and life of the roller. The adhesive must be applied in sufficient quantity to hold the flock. Silk screen roller coating, dipping, spraying or brushing are some of the possibilities. The electro-static application of the flock may also be enhanced by the use of an adhesive which is conductive. An epoxy such as manufactured by the Nytak Chemical Co. No. 10E007 and No. 10E008 is a preferred type of adhesive.

Flocking fibers of different materials (e.g., cotton, polyester and teflon) and thicknesses may be used. The preferable flocking fiber is nylon, three-denier thick, 0.030 inches to 0.040 inches (0.8 to 1.0 mm) long. Flocking density for best results should be approximately 200,000–300,000 fibers per square inch ($3–4.5\times10^3/cm^2$).

The top and bottom flanged ends 2 and 3 shown in FIG. 7 are made from a low-heat conducting material such as polypropylene or polyester. The flanges prevent heat transfer from the tubular member 1 of the roller body to an individual's fingers when winding the heated roller into the hair. The flanged ends 2 and 3 having venting holes 12 to further reduce heat conduction and cool the flanged ends 2 and 3. The total diameter 15 of the flanged ends is larger than the diameter of the roller body to allow for ease in handling, to space the roller from the scalp thereby reducing the possibility of discomfort, and to give the user the mechanical advantage in rolling the hair tightly on the roller. Tight contact of the hair with the tubular member 1 of the roller body improves heat transfer and also aids in curl formation due to the stress imposed to the hair. The flanged ends 2 and 3 further prevent hair from slipping off the tubular member 1.

Figure 1:
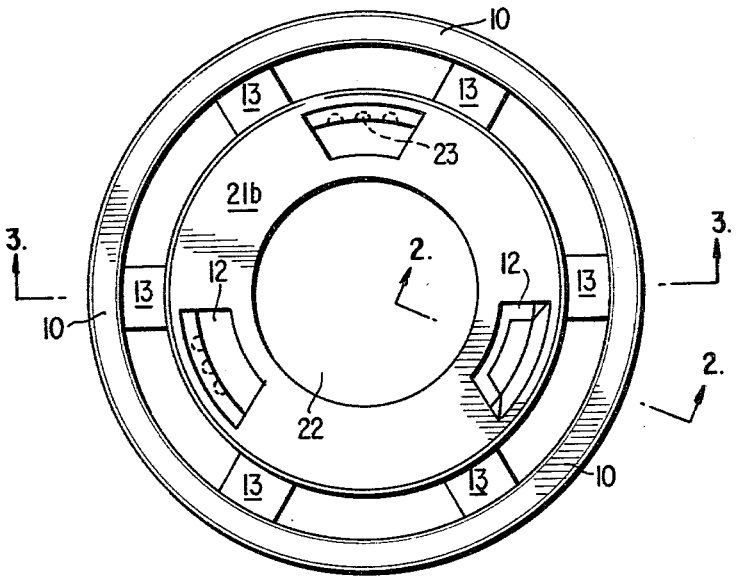
FIG. 1 is a bottom view of a bottom flanged end according to the invention.
Figure 2:
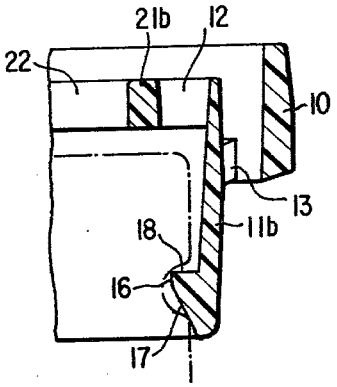
FIG. 2 is a partial sectional view taken along lines 2—2 of FIG. 1 showing the bottom flanged end locking portion structure.
Figure 3:
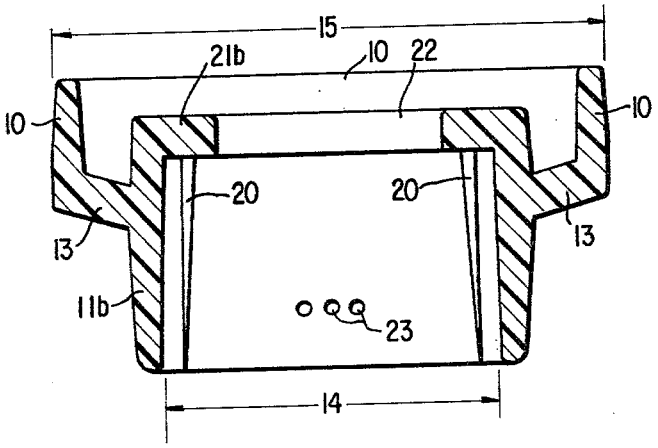
FIG. 3 is a sectional view of FIG. 1 taken along lines 3—3 showing the bottom flanged end base means and crushing rib structure.

Construction of the bottom flanged end 3 is illustrated in FIGS. 1–3. The flanged end 3 consists of a radial flange section 10 connected to base means for receiving an end of the tubular member 1. The flange 10 is attached by members 13 to the base means. The inside diameter 14 of the base means is slightly larger than the outside diameter of the tubular member 1. The base means consists of bottom base portion 21b and bottom base sides 11b. At selected points in the bottom base portion 21b, locking means and venting holes 12 are provided. The locking means on the bottom base sides 11b is comprised of a camming surface 17, a locking lip 16, and a locking surface 18.

The tubular member 1 can be in the form of a high heat conducting tube 1a and 1b as shown in FIGS. 8a and 8b, respectively, or a cartridge 1c as illustrated in FIG. 9. As shown in FIGS. 8b and 9, the tubular member 1 can have radial grooves 19 for mating with the locking means of the base means of the flanged ends 2 and 3. After the outer surface of the tubular member 1 is flocked and cured, each flanged end is fitted over the tubular member 1. As either flanged end is fitted over tubular member 1, the end of the tubular member 1 first contacts the camming surface to bend the resilient bottom base side 11b back away from the tubular member 1. The end of the tubular member 1 then passes the locking lip 16 and comes into contact with the crushing ribs 20 to affix the bottom base portion 21b to the tubular member 1. As the flanged end is located into place, the locking lip 16 enters the groove 19 and the locking surface 18 comes into contact with the groove 19 to secure the flanged end 3 and prevent the flanged end 3 from being removed from the tubular member 1.

Figure 5:
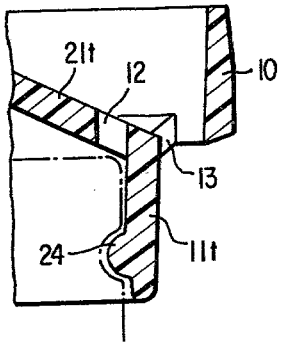
FIG. 5 is a partial sectional view taken along lines 5—5 of FIG. 4 showing the top flanged end radial protrusions structure.
Figure 4:
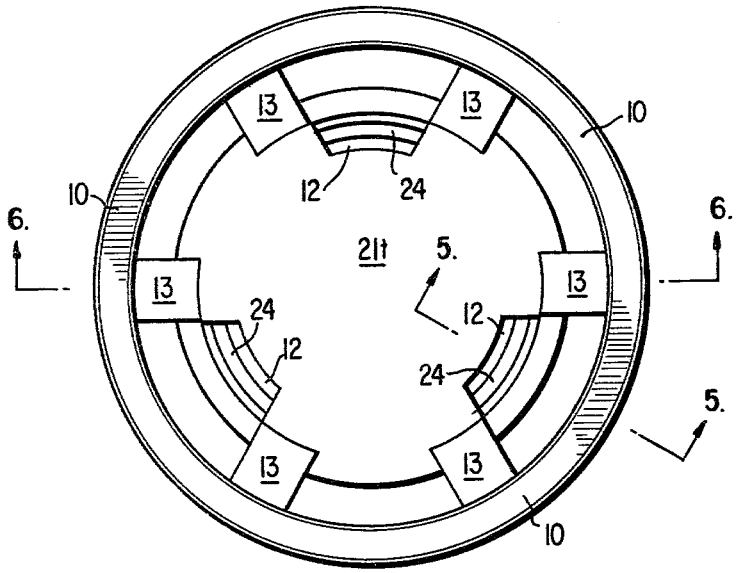
FIG. 4 is a top view of a top flanged end according to the invention.
Figure 6:
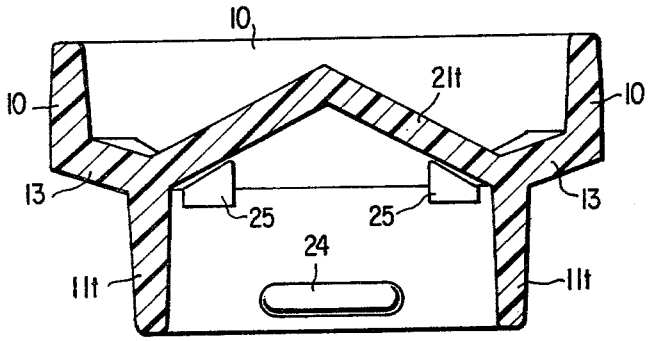
FIG. 6 is a sectional view taken along lines 6—6 of FIG. 4 showing the top flanged end base means and spacing projections structure.
Figure 10:
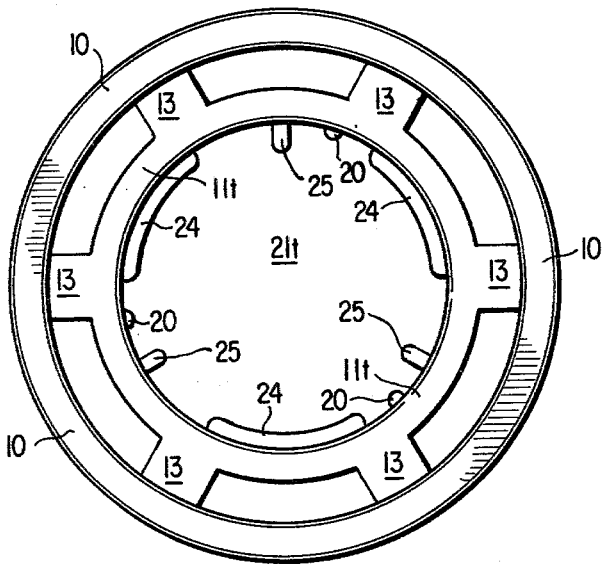
FIG. 10 is a bottom view of a top flanged end embodiment without vent holes.

FIGS. 4–6 illustrate an embodiment of the top flanged end 2 configuration. Radial flange section 10 is connected via members 13 to top base portion 21t and top base sides 11t forming a base means. In the top flanged end 2 arrangement, the top base portion 21t tapers to a conical point and covers the entire end of the tubular member 1 except for the venting holes 12. The top flanged end 2 may include the same locking means and accompanying arrangement as the bottom flange 3 to allow the flanged end to be secured to the tubular member 1. As shown in FIGS. 5, 6 and 10, the locking means may be radial protrusions 24 located on the inner surface of the top base sides 11t. When attaching the top flanged end 2, top base sides 11*t* will be cammed out by the radial protrusion 24 riding against the outside of the tubular member 1. Radial protrusion 24 lines up with groove 19 in the roller when the end of the tubular member 1 is in contact with the spacing projections 25 which may optionally be included in said top base portion 21*t* to space the tubular member from the top base portion and to prevent contact between the first end of said tubular member and the top base portion. Radial projections 24 establish an interference lock with the groove 19.

To guard the user from coming into contact with the hot inner surface of the tubular member 1, bottom base portion 21*b* acts as a guard ring located on the bottom flanged end 3. Opening 22 permits the heating post or other means for heating the curler to enter the tubular member 1, but prevents accidental entry of the fingers.

To prevent rotation of the flanged end with respect to the tubular member 1, crushing ribs 20 are provided which dig into the flocked surface of the tubular member 1 and prevent rotation of the flanged ends in use. Other anti-rotation means, such as knurls, could be provided on the inside flange surface.

Other convenient ways can be found to structure the locking means to attach or anchor the flocked tubular member to the flanged ends to satisfy the requirements of a mechanical bond withstanding axial as well as rotational forces. One alternative is shown in FIGS. 3, 8*a* and 8*b*. Convex protrusions 26 are placed on both ends of the tubular member 1. The bottom base sides 11*b* would then be provided with concave indentations 23 which, on assembly, would mate with the convex protrusions 26 and lock the flanged end to the tubular member to resist axial as well as torsional forces. Another alternative, not shown, is the employment of a threaded tubular member in combination with a complementary-threaded base means of the flanged ends.

The flanged ends 2 and 3 could also be attached to the tubular member 1 by cement, but this is an expensive and unclean procedure in manufacturing and the permanence and reliability of a bond between flocked fibers and a plastic flanged end is not always satisfactory.

The flanged ends could also be bonded or attached as described above before flocking of the tubular member 1. The flanged ends would then be masked when the flocking adhesive is applied to the tubular member. This is also an expensive operation and the curing temperatures necessary for the bonding cement might damage the plastic parts.

Various changes may be made in the details of the invention, as disclosed, without sacrificing the advantages thereof or departing from the scope of the appending claims. Furthermore, although the present invention has been disclosed and discussed with particular regard to its exceptional advantages in terms of flocked hair curler structures, it may be understood that the invention may be employed in several industrial applications for the assembly of flanged hair curler arrangements.

The number, shape and placement of the vents 12, radial protrusions 24 and crushing ribs 20 can also be altered to accommodate a specific type of flocking, tubular member or base means. The basic purpose of the crushing ribs 20 is to grasp the tubular member 1 and prevent axial rotation thereof with respect to the flanged ends. The height of the crushing ribs 20, as well as their width and length, may be varied to properly perform this purpose. Alternatively, shear ribs (not shown) may be used in place of or in combination with the crushing ribs 20. The structure of the spacing projections 25 is similarly variable.

What is claimed is:

1. A hair curling roller comprising:

a. a tubular high heat conducting member with first and second ends and a flocked outer surface;

b. a top radial flanged end having a top base means engaging the flocked outer surface of the first end of said tubular member; and c. a bottom radial flanged end having a bottom base means engaging the flocked outer surface of the second end of said tubular member.

2. The hair curling roller of claim 1 wherein said top radial flanged end is comprised of a radial flange section and a plurality of members connecting said radial flange section to said top base means.

3. The hair curling roller of claim 1 wherein said top base means is comprised of a top base portion and top base sides attached to said top base portion, said top base sides having a locking means for engaging the flocked outer surface of the first end of said tubular member.

4. The hair curling roller of claim 3 wherein said top base portion includes venting holes.

5. The hair curling roller of claim 3 wherein the flocked outer surface of the first end of said tubular member has a radial groove therein and said locking means is comprised of a camming surface for communication with the flocked outer surface of the first end when said top flanged end is fitted over the first end of said tubular member; a locking lip engaging said radial groove in the flocked outer surface of said tubular member, said locking lip adjacent said camming surface; and a locking surface adjacent said locking lip for engaging said radial groove in the flocked outer surface for preventing said top flanged end from disengaging said radial groove.

6. The hair curling roller of claim 3 wherein said locking means is comprised of one or more concave identations and the flocked outer surface of said tubular member has one or more convex protrusions for receiving said concave indentations.

7. The hair curling roller of claim 3 wherein said locking means is comprised of one or more radial protrusions and the flocked outer surface of said tubular member has a radial groove therein for receiving said protrusions.

8. The hair curling roller of claim 3 wherein said ends are a low-heat conducting material wherein said ends prevent heat transfer from said tubular member to an individual's fingers when winding hair around said roller in a heated condition.

9. The hair curling roller of claim 8 wherein said bottom base means and said tubular member each have an aperture therein which are in registry for receiving a heating means.

10. The hair curling roller of claim 9 wherein said tubular member is a cartridge filled with a material that upon heating will change its state from solid to liquid.

11. The hair curling roller of claim 10 wherein said material is wax.

12. The hair curling roller of claim 1 wherein said top base means includes one or more crushing ribs for contact with the flocked surface of said tubular member thereby preventing axial rotation of said flanged end with respect to said tubular member.

13. A hair curling roller for use with a heating means comprising:

a. a cartridge comprising a high heat conducting material with a flocked outer surface and filled with a material that upon heating will change its state from solid to liquid with first and second ends and a flocked outer surface;

b. a top radial flanged end having a top base means connected to the first end of said tubular member, said top radial flanged end comprised of a radial flanged section and a plurality of members connecting said radial flanged section to said top base means;

c. said top base means comprised of a top base portion and top base sides attached to said top base portion, said top base sides having one or more first radial protrusions, the flocked outer surface of said tubular member having a first groove therein for receiving said first protrusions;

d. a bottom radial flanged end having a bottom base means connected to the second end of said tubular member, said bottom radial flanged end comprised of a radial flanged section and a plurality of members connecting said radial flanged section to said bottom base means;

e. said bottom base means comprised of a bottom base portion and bottom base sides attached to said bottom base portion, said bottom base sides having one or more second radial protrusions, the flocked outer surface of said tubular member having a second groove therein for receiving said second protrusions wherein said ends prevent heat transfer from said tubular member to an individual's fingers when winding hair around the roller in a heated condition.

14. The hair curling roller of claim 13 wherein said top base portion includes spacing projections to space the tubular member from the top base portion and to prevent contact between the first end of said tubular member and the top base portion.

15. The hair curling roller of claim 13 wherein at least one of said top and bottom base means includes one or more crushing ribs for contact with the flocked outer surface of said tubular member thereby preventing axial rotation of said ends with respect to said tubular member.

* * * * *

UNITED STATES PATENT AND TRADEMARK OFFICE

CERTIFICATE OF CORRECTION

PATENT NO. : 4,202,360

DATED : May 13, 1980

INVENTOR(S) : Henry J. Walter

It is certified that error appears in the above-identified patent and that said Letters Patent are hereby corrected as shown below:

Col. 7, line 2, delete "with a flocked outer surface and"

In the drawings, FIG. 8A, change "22" to -- 26 --

Signed and Sealed this

*Twentieth* Day of *January 1981*

[SEAL]

*Attest:*

RENE D. TEGTMEYER

*Attesting Officer*

*Acting Commissioner of Patents and Trademark*